US007390111B2

(12) United States Patent
Lippis

(10) Patent No.: US 7,390,111 B2
(45) Date of Patent: Jun. 24, 2008

(54) MOUNTING CLIP FOR LIGHTING FIXTURES

(75) Inventor: Michael C. Lippis, Spokane, WA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 11/333,260

(22) Filed: Jan. 18, 2006

(65) Prior Publication Data

US 2006/0198127 A1 Sep. 7, 2006

Related U.S. Application Data

(63) Continuation of application No. 11/071,891, filed on Mar. 4, 2005, now Pat. No. 7,234,832.

(51) Int. Cl.
*F21V 21/00* (2006.01)

(52) U.S. Cl. ..... 362/396; 362/147; 362/365; 248/228.7

(58) Field of Classification Search ..... 362/396, 362/147, 148, 150, 364, 365, 370, 404; 248/228.7, 248/230.7, 231.81
See application file for complete search history.

(56) References Cited

U.S. PATENT DOCUMENTS 420,607 A 2/1890 Reinhardt
3,233,297 A * 2/1966 Havener ..... 403/397
3,371,900 A 3/1968 Jacobs
3,957,268 A 5/1976 Silberman
3,994,050 A 11/1976 Bub
4,041,657 A * 8/1977 Schuplin ..... 52/39
4,088,293 A 5/1978 Delmore
4,667,910 A * 5/1987 Atterby et al. ..... 248/71
4,726,165 A * 2/1988 Brinsa ..... 52/665
5,004,199 A * 4/1991 Suk ..... 248/218.4
5,931,432 A 8/1999 Herold
5,941,625 A * 8/1999 Morand ..... 362/148
6,068,387 A 5/2000 Hilton
6,327,758 B1 12/2001 Petrakis
6,547,201 B2 * 4/2003 Barich et al. ..... 248/316.7
6,896,394 B2 * 5/2005 Houle ..... 362/365

* cited by examiner

*Primary Examiner*—Sandra L. O'Shea
*Assistant Examiner*—Gunyoung T. Lee
(74) *Attorney, Agent, or Firm*—Marcus R. Mickney; Mark S. Bicks; Alfred N. Goodman

(57) ABSTRACT

An adjustable lighting fixture has a moveable housing. A first housing has a first opening and a second opening. A second housing is adapted to movably engage the first housing. A resilient member is connected to the second housing and adapted to be received by one of the first and second openings in the first housing. The first opening corresponds to a contracted position of the lighting fixture and the second opening corresponds to an expanded position of the lighting fixture. A lamp disposed in the lighting fixture has a longitudinal axis that is substantially perpendicular to a direction of movement of the first and second housings.

17 Claims, 7 Drawing Sheets

MOUNTING CLIP FOR LIGHTING FIXTURES

CROSS REFERENCE TO RELATED APPLICATION

This application is a continuation of U.S. patent application Ser. No. 11/071,891, filed Mar. 4, 2005 and entitled "Adjustable Lighting Fixture."

FIELD OF THE INVENTION

The present invention relates to a mounting clip for lighting fixtures. More specifically, the present invention relates to a mounting clip for securing a lighting fixture to a t-bar of a ceiling grid. Still more particularly, the present invention relates to a mounting clip having a flexible leg to facilitate installation and removal of the lighting fixture. The flexible leg prevents upward movement of the installed lighting fixture, and deforming the flexible leg allows the lighting fixture to be removed from the ceiling grid.

BACKGROUND OF THE INVENTION

Many conventional lighting fixtures are not adjustable. Extreme manipulation of those non-adjustable lighting fixtures is required to install the lighting fixture in an environment that does not provide much free space, such as is prevalent when installing lighting fixtures in a ceiling grid. The installer must be very careful when manipulating the non-adjustable lighting fixture to ensure the lighting fixture is not damaged during the installation process. Furthermore, such manipulation slows down the installation process, as well as making installation of the lighting fixture difficult and inefficient. Thus, a need exists for a lighting fixture that is adjustable such that it may be easily installed in a compact position and then extended to an installation position, thereby providing a quick and efficient installation procedure.

Moreover, non-adjustable lighting fixtures require large and bulky shipping packages, which increases the costs associated with the lighting fixtures. Thus, a need exists for a lighting fixture that is adjustable such that the size of the lighting fixture may be reduced to provide a smaller and more compact shipping package.

Some exiting lighting fixtures are adjustable. However, one problem with the existing adjustable lighting fixtures is that the lighting fixture is adjustable in the direction of the length of the lamp. Therefore, the lamps cannot be installed in the lighting fixture unless the lighting fixture is in the extended position. This requires multiple steps to fully install such a conventional lighting fixture. The installer must first install the lighting fixture when it is in the compact position without a lamp in place. Once the lighting fixture is installed in its fully extended position, lamps may then be installed in the lighting fixture. Thus, a need exists for an adjustable lighting fixture that is adjustable with the lamps installed to provide a quick and efficient installation process.

Examples of conventional adjustable lighting fixtures include U.S. Pat. No. 2,532,023 to Guth, Jr.; U.S. Pat. No. 3,609,338 To Kripp; U.S. Pat. No. 3,673,402 to Weiss; U.S. Pat. No. 4,161,019 to Mulvey; U.S. Pat. No. 4,424,554 to Woloski et al.; and U.S. Pat. No. 5,624,178 to Lee, Jr.; the subject matter of each of which is hereby incorporated by reference.

A need exists for an improved adjustable lighting fixture.

SUMMARY OF THE INVENTION

Accordingly, an object of the present invention is to provide an adjustable lighting fixture.

Another object of the present invention is to provide an adjustable lighting fixture that is quickly and easily installed.

Another object of the present invention is to provide an adjustable lighting fixture that is easily installable in area restricted locations without requiring difficult maneuvering of the lighting fixture.

Another object of the present invention is to provide a lighting fixture that is adjustable with a lamp disposed therein.

The foregoing objects are basically attained by providing an adjustable lighting fixture that has a moveable housing. A first housing has a first opening and a second opening. A second housing is adapted to movably engage the first housing. A resilient member is connected to the second housing and adapted to be received by one of the first and second openings in the first housing. The first opening corresponds to a contracted position of the lighting fixture and the second opening corresponds to an expanded position of the lighting fixture. A lamp disposed in the lighting fixture has a longitudinal axis that is substantially perpendicular to a direction of movement of the first and second housings.

The foregoing objects are also attained by a method of installing an adjustable lighting fixture having telescoping first and second housings in a ceiling grid. A lamp is disposed in the adjustable lighting fixture. The first and second housings are moved in a first direction substantially perpendicular to a longitudinal axis of the lamp to put the lighting fixture in a contracted position. The adjustable lighting fixture is positioned within the ceiling grid. The first and second housings are moved in a second direction substantially perpendicular to the longitudinal axis to put the lighting fixture in an extended position.

Other objects, advantages and salient features of the invention will become apparent from the following detailed description, which, taken in conjunction with annexed drawings, discloses a preferred embodiment of the present invention.

BRIEF DESCRIPTION OF THE DRAWINGS

Referring to the drawings which form a part of this disclosure.

Throughout the drawings, like reference numerals will be understood to refer to like parts, components and structures.

DETAILED DESCRIPTION OF THE INVENTION

Figure 1:
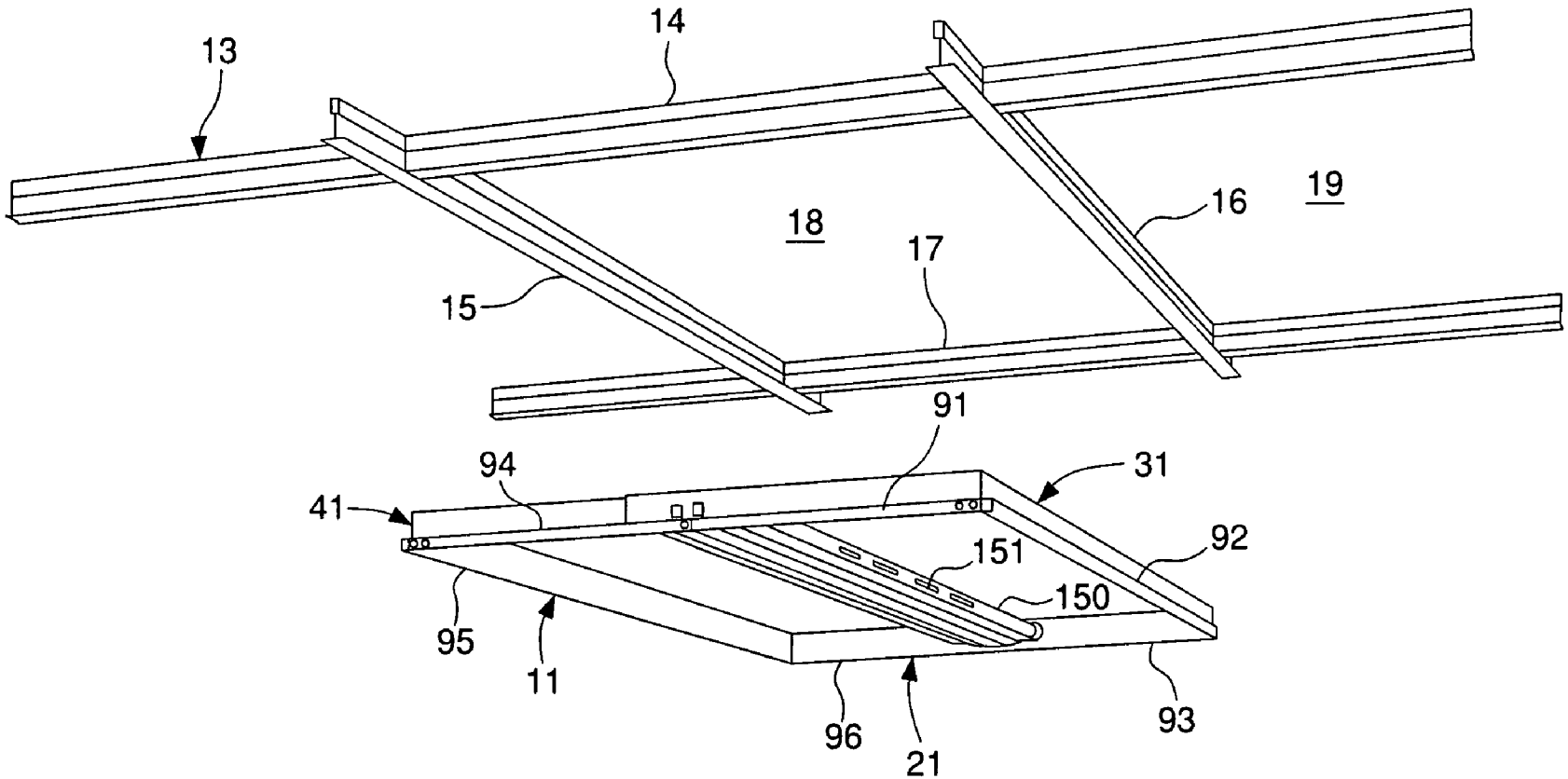
FIG. 1 is a perspective view of an adjustable lighting fixture according to an embodiment of the present invention prior to installation in a ceiling grid.

Referring to FIGS. 1-14, a lighting fixture 11 in accordance with the present invention has a moveable housing assembly 21 to position the lighting fixture in a contracted or expanded position. A first housing 31 has a first opening 33 and a second opening 35. A second housing 41 is adapted to movably engage the first housing 31. A resilient member 43 is connected to the second housing 41 and adapted to be received by one of the first and second openings in the first housing 31. The first opening 33 corresponds to a contracted position of the lighting fixture 11 and the second opening corresponds 35 to an expanded position of the lighting fixture. A lamp 13 disposed in the lighting fixture has a longitudinal axis 14 that is substantially perpendicular to a direction of movement of the first and second housings. A mounting clip 71 may be used to securely retain the adjustable lighting fixture in the ceiling grid 13.

Figure 9:
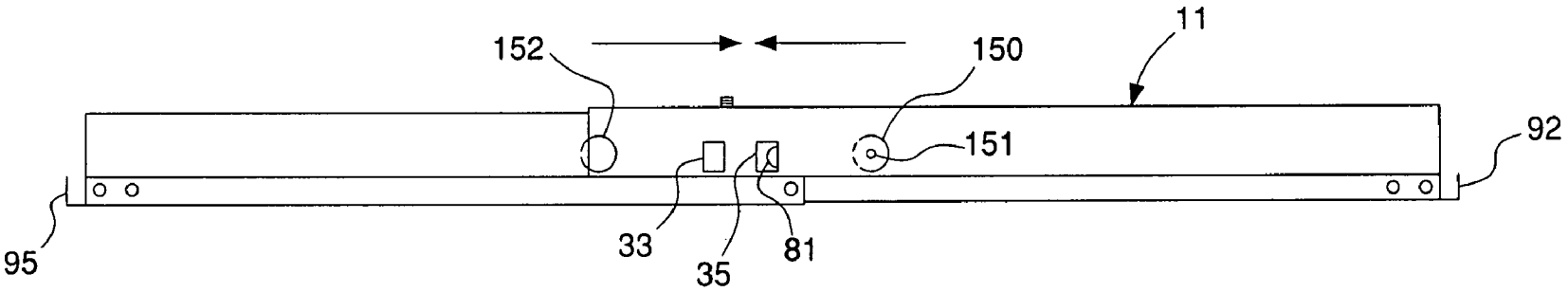
FIG. 9 is a side elevational view of an adjustable lighting fixture of FIG. 1 in an expanded position.

The present invention relates to an adjustable lighting fixture 11 that is easily installable in applications having limited space, such as a ceiling grid 13, as shown in FIG. 1. The lighting fixture 11 has a first housing 31 that is movably connected to a second housing 41. The lighting fixture 11 is installed in a contracted position, as shown in FIGS. 1 and 9, such that the lighting fixture is positioned between T-bars 14, 15, 16 and 17 of a ceiling grid 13 without requiring tilting and otherwise maneuvering and manipulating the lighting fixture during installation. The width of the lighting fixture in the contracted position is less than the distance separating adjacent T-bars 15 and 16 of the ceiling grid, as shown in FIG. 1. Once installed, the lighting fixture 11 is expanded by moving the second housing 41 away from the first housing 31 such that opposite edges of the lighting fixture rest on the T-bars 15 and 16. The first and second housings preferably move in a direction that is substantially perpendicular to the axial length of a lamp disposed therein. By providing movement of the first and second housings in a direction substantially perpendicular to a longitudinal axis of a lamp, the first and second housings may be moved with the lamp installed therein.

Figure 2:
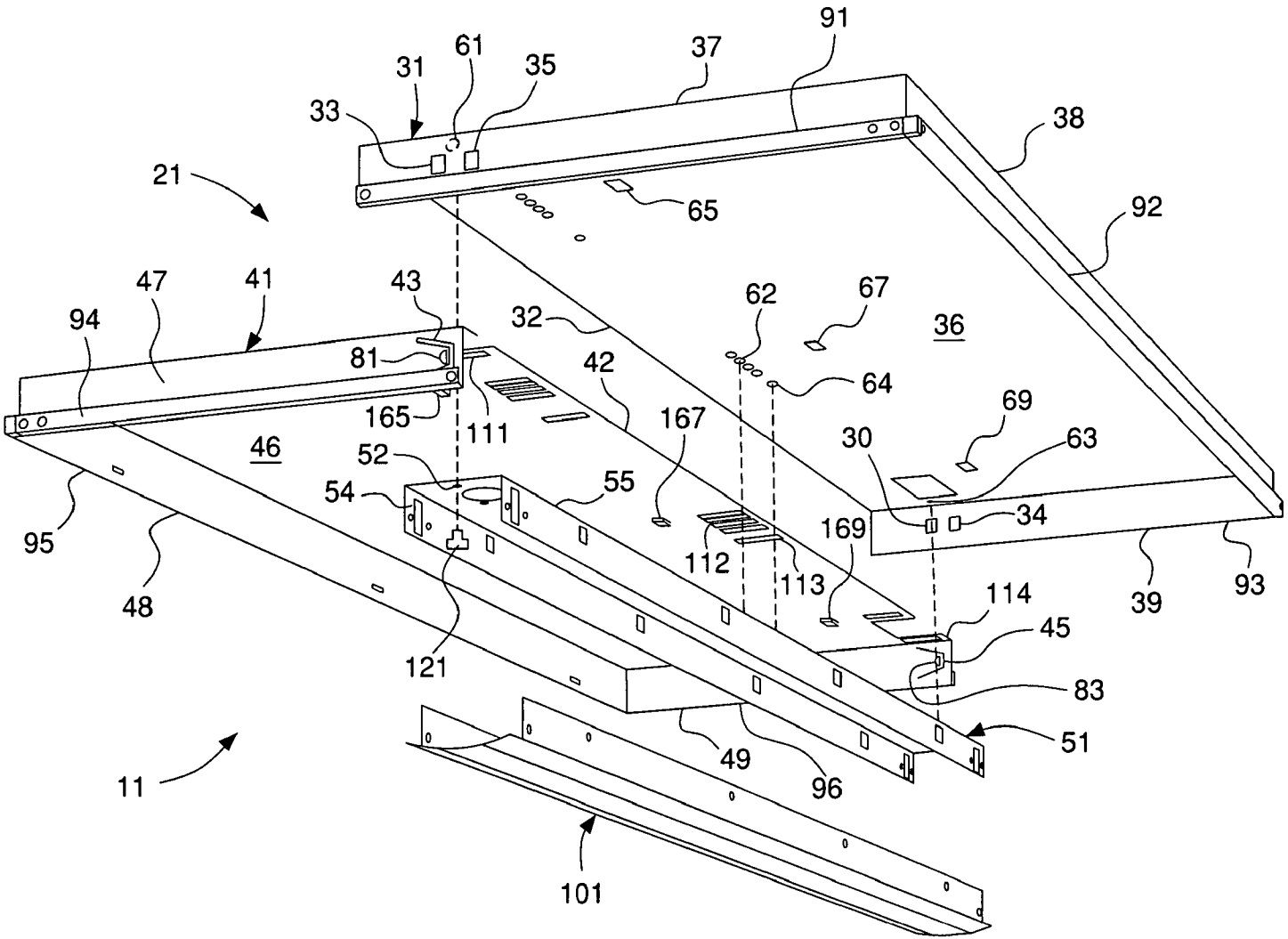
FIG. 2 is an exploded perspective view of an adjustable lighting fixture of FIG. 1.
Figure 3:
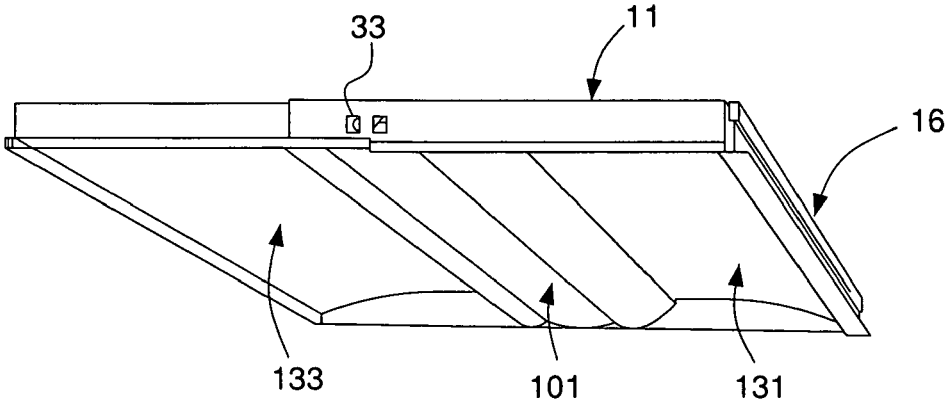
FIG. 3 is a perspective view of the adjustable lighting fixture of FIG. 1 with reflectors and a lens secured thereto.
Figure 4:
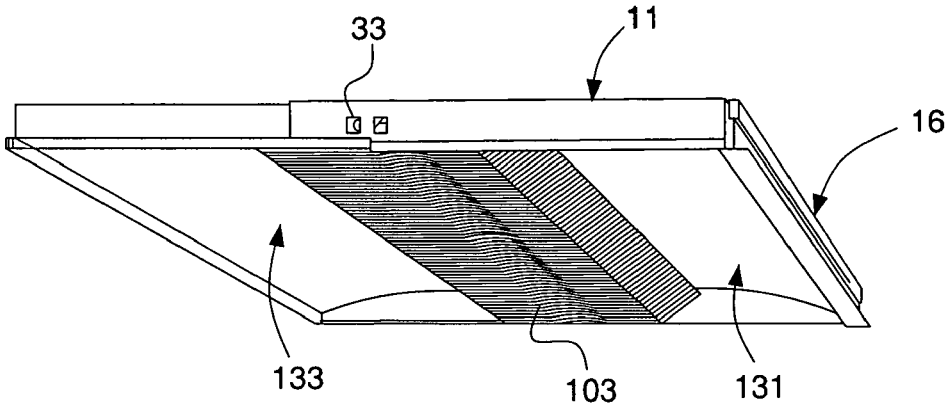
FIG. 4 is a perspective view of the adjustable lighting fixture of FIG. 1 with reflectors and a louver secured thereto.
Figure 5:
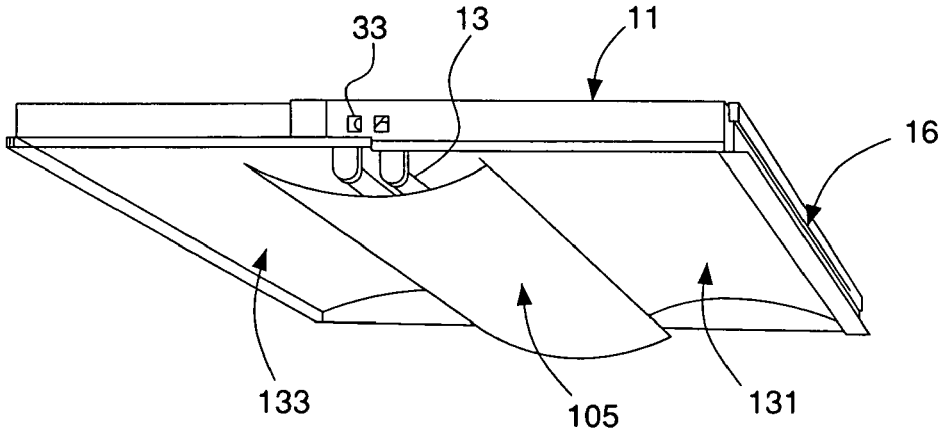
FIG. 5 is a perspective view of the adjustable lighting fixture of FIG. 1 with reflectors and a basket secured thereto.
Figure 6:
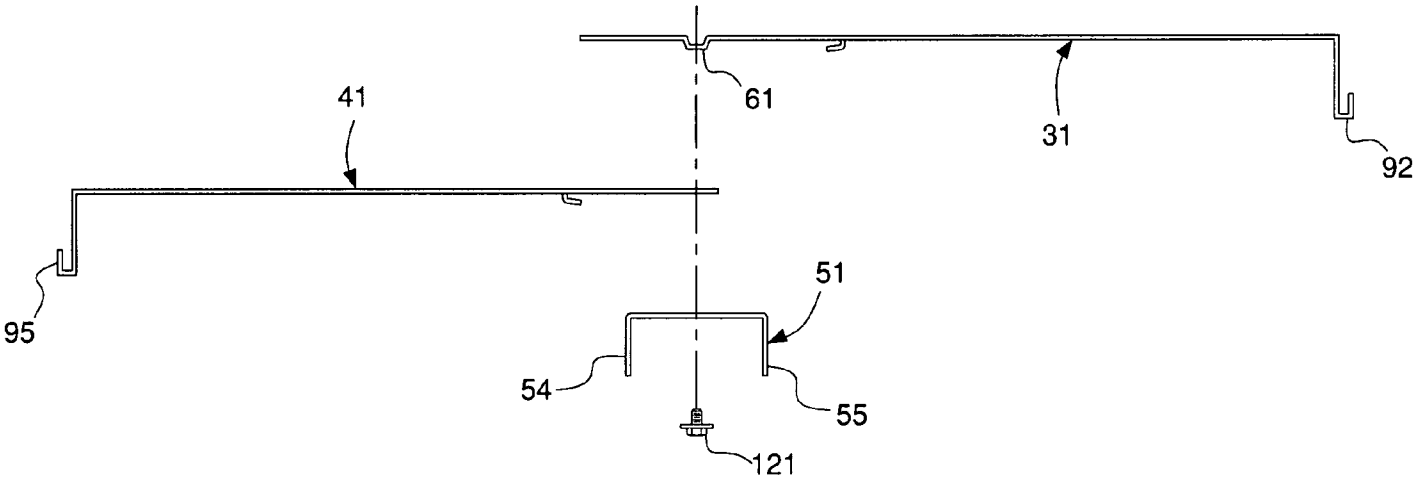
FIG. 6 is a side elevational view in cross section of first and second housings and a channel of the adjustable lighting fixture prior to assembly.
Figure 7:
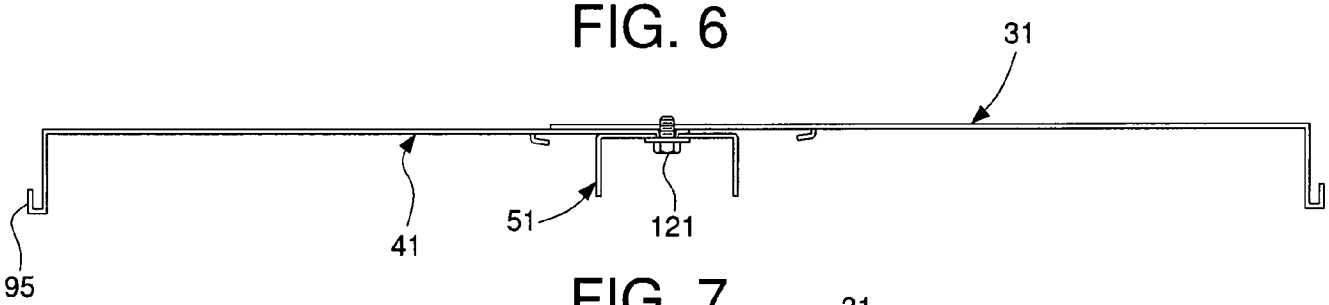
FIG. 7 is a side elevational view in cross section of an adjustable lighting fixture in an expanded position.

A conventional ceiling grid 13 is shown in FIG. 1. Main T-bar support members 14 and 17 run longitudinally and cross support T-bar members 15 and 16 run laterally. Openings 18 are formed between the T-bar members 14, 15, 16 and 17. Each T-bar member has an inner mounting surface adapted to receive a lighting fixture support surface The first housing 31 has a first base 36, which is preferably substantially planar, as shown in FIG. 2. First, second and third walls 37, 38 and 39, respectively, extend substantially perpendicularly from outer edges of the first base. Mounting surfaces 91, 92 and 93 formed at the end of each of the first, second and third walls rest upon a surface of the ceiling grid. T-bars to retain the first housing 31 in the ceiling grid 13. Preferably, the first base 36 is substantially rectangular, such that the first, second and third walls extend from three edges of the first base and the remaining edge 32 does not have a wall extending therefrom, as shown in FIG. 1. The first and third walls 37 and 39 are preferably substantially parallel. Preferably, the first housing 31 is made of steel.

First and second openings 33 and 35 are disposed in the first wall 37, and are adapted to receive a resilient member connected to the second housing. A boss 61 is disposed on a lower surface of the first base 36. Preferably, four bosses 61, 62, 63 and 64 are linearly aligned on the lower surface of the first base 36. Retaining members 65, 67 and 69 are disposed on a lower surface of the first base 36 and corresponding retaining members 165, 167 and 169 are disposed on a lower surface of the second base 46 and are adapted to receive additional lighting fixture accessories, such as a lens 101 (FIG. 3), a louver 103 (FIG. 4), a basket 105 (FIG. 5), or any other suitable attachment. Reflectors 131 and 133 may also be secured to the lighting fixture 11.

The second housing 41 has a second base 46, which is preferably substantially planar, as shown in FIG. 2. Fourth, fifth and sixth walls 47, 48 and 49, respectively, extend substantially perpendicularly from outer edges of the second base. Mounting surfaces 94, 95 and 96 formed at the end of each of the first, second and third walls rest upon a surface of the ceiling grid T-bars to retain the second housing 41 in the ceiling grid 13. Preferably, the second 46 base is substantially rectangular, such that the fourth, fifth and sixth walls extend from three edges of the second base and the remaining edge 42 does not have a wall extending therefrom. The fourth and sixth walls 47 and 49 are preferably substantially parallel. Preferably, the second housing 41 is made of steel.

A first resilient member 43 is connected to the fourth wall 47 of the second housing 41. The first resilient member extends slightly outwardly to facilitate engaging the first and second openings 33 and 35 in the first housing 31. A tab 81 on the first resilient member 43 engages the openings to secure the lighting fixture in that position. Preferably, a second resilient member 45 having a second tab 83 extends outwardly from the sixth wall 49 of the second housing 41 and is adapted to engage third and fourth openings 30 and 34 in the third wall 39.

A channel 51 is secured to the first housing 31 through the second housing 41, as shown in FIGS. 2, 6, 7 and 8. A fastener hole 52 in the channel 51 is aligned with an elongated slot 111 in the second housing 41 and the boss 61 in the first housing 31. A fastener 121 is inserted through the fastener hole 52 in the channel 51, through the elongated slot 111 in the second housing 41 and through a bore in the boss 61 in the first housing 51, thereby securing the second housing between the first housing and the channel. Preferably, there are four fastener holes in the channel 51 aligned with corresponding slots 111, 112, 113 and 114 in the second housing 41 and aligned with corresponding bosses 61, 62, 64 and 63 in the first housing 31. Preferably, the channel 51 is substantially U-shaped with a base member 53 and legs 54 and 55 extending substantially perpendicularly therefrom.

Sockets 171 may be connected at opposite ends of the channel 51 to receive lamps 150 and 152, as shown in FIG. 1.

Figure 12:
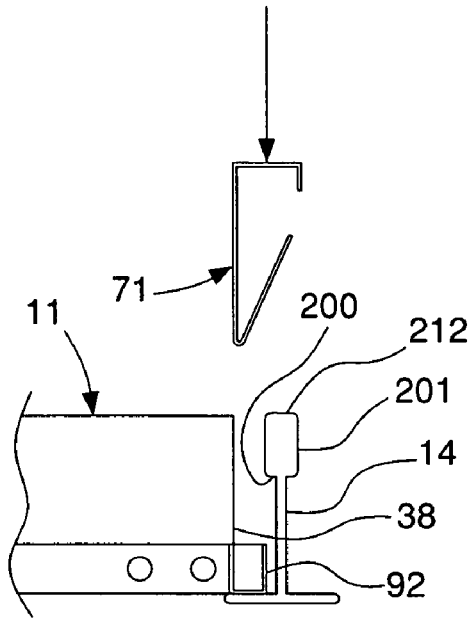
FIG. 12 is a front elevational view of a mounting clip of FIG. 9 as it approaches a lighting fixture to be secured to a t-bar of a ceiling grid.
Figure 13:
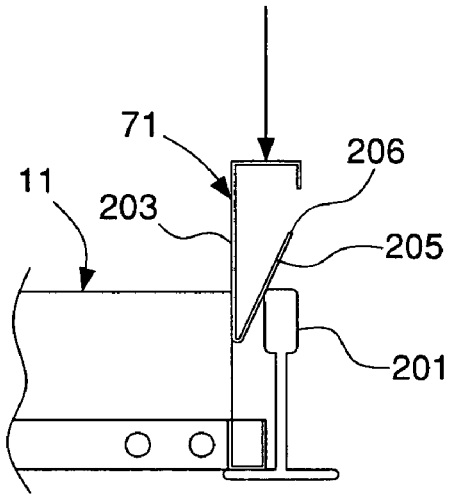
FIG. 13 is a front elevational view of a mounting clip being positioned to secure an adjustable lighting fixture to a t-bar of a ceiling grid.
Figure 14:
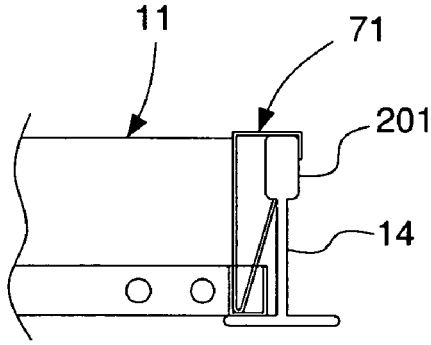
FIG. 14 is front elevational view of a mounting clip securing an adjustable lighting fixture to a t-bar of a ceiling grid.

A mounting clip 71 may be disposed between a T-bar and the lighting fixture 11 to further retain the expanded lighting fixture within the ceiling grid 13, as shown in FIGS. 11-14. The mounting clip 71 has a first leg 203 adapted to be disposed against a wall of the lighting fixture. A second leg 205 extends upwardly from a first end 202 of the first leg. A second end 206 of the second leg 205 is adapted to engage a lower portion 200 of base 201 of a T-bar member 14, as shown in FIG. 14. A third leg 211 extends from a second end 210 of the first leg 203. A fourth leg 221 extends from a second end 220 of the third leg to form a hook portion, which is adapted to engage an upper portion 212 of a T-bar member 14, as shown in FIG. 14. Preferably, the mounting clip 71 is resiliently formed of stainless steel. With the mounting clip in position, as shown in FIG. 14, an upward force on the lighting fixture 11 does not dislodge the lighting fixture due to the second end 206 engaging the lower portion 200 of the base 201 of the T-bar member 14. Pushing the second leg 203 inwardly with a tool, such as a screwdriver, allows the mounting clip 71 to be removed. Alternatively, the lighting fixture may be moved to its contracted position, thereby allowing the mounting clip 71 to be easily unhooked from the T-bar member 14 once the lighting fixture has been removed.

Assembly and Operation

Referring to FIGS. 1-14, the adjustable lighting fixture 11 of the present invention may be installed in any suitable support member, such as a conventional ceiling grid 13 formed by a plurality of T-bar members 14, 15, 16 and 17, as shown in FIG. 1.

The lighting fixture is shown in a contracted position in FIGS. 1 and 9. The width of the lighting fixture between the mounting surfaces 92 and 95 in the contracted position is shorter than the width between T-bar members 15 and 16, thereby allowing the lighting fixture to be easily positioned above the support surfaces of the T-bar members without requiring difficult manipulation of the lighting fixture. In the contracted position, the resilient members engage second openings 35 and 34 of the first housing 31.

Figure 10:
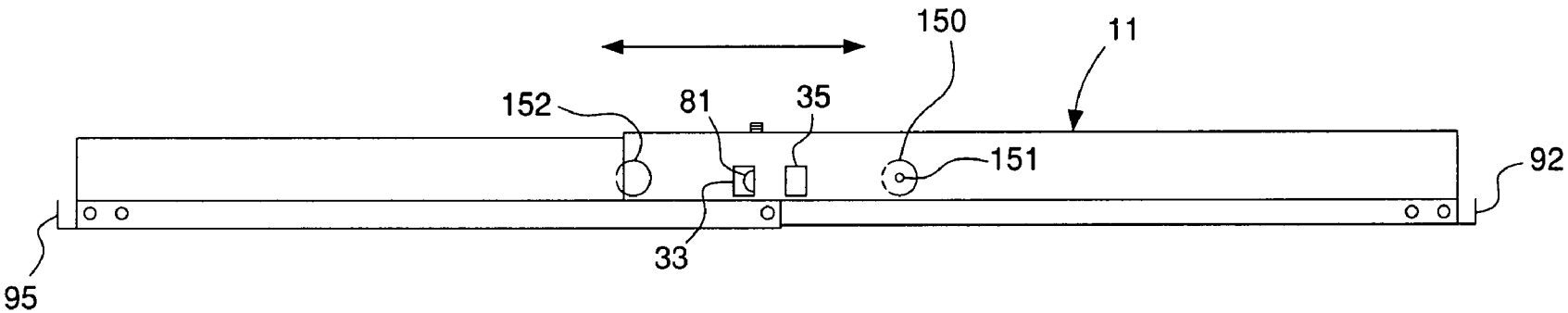
FIG. 10 is a side elevational view of an adjustable lighting fixture of FIG. 9 in a contracted position.
Figure 11:
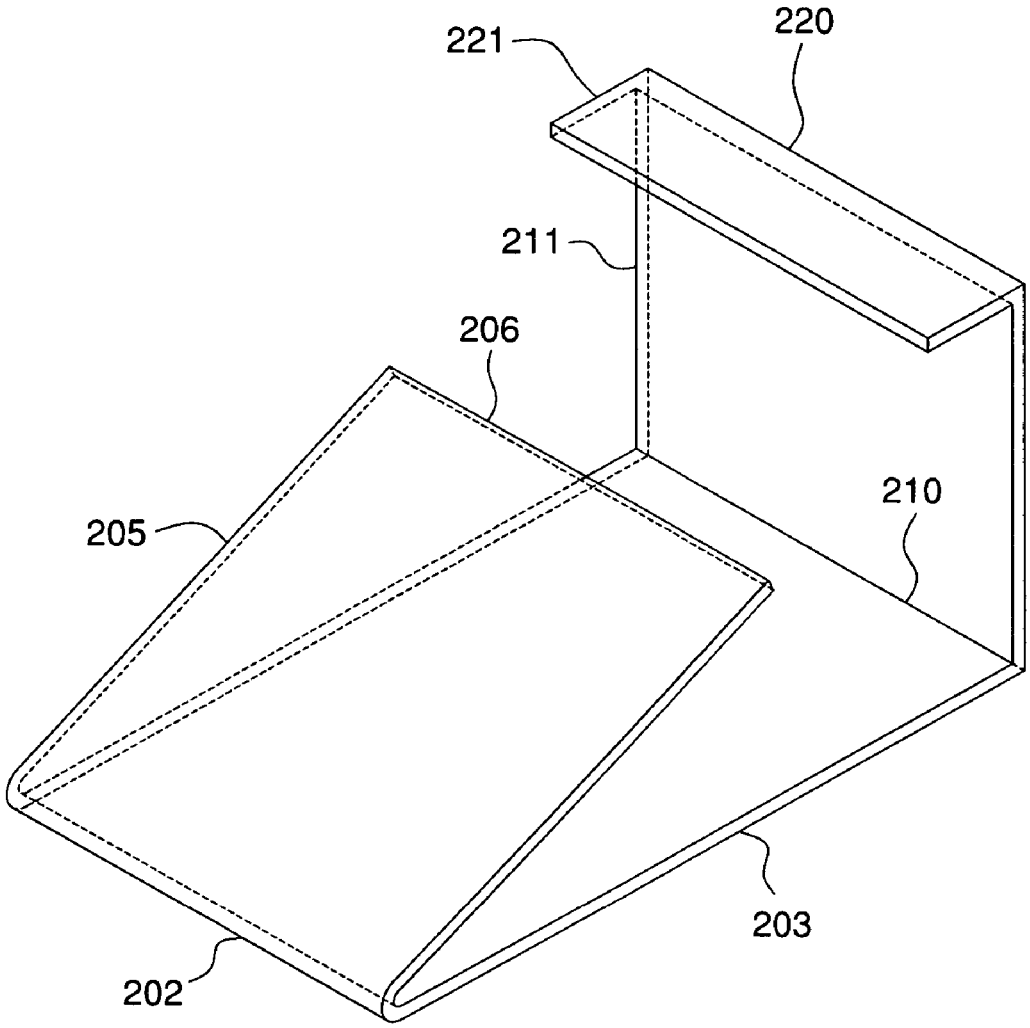
FIG. 11 is a perspective view of a mounting clip.

The tabs 81 and 83 of the resilient members 43 and 45 are deflected inwardly to move the first and second housing apart from each other, as indicated by the arrows in FIG. 10, to move the lighting fixture to the expanded position of FIG. 10. The mounting surfaces 92 and 95 of the lighting fixture 11 are now in a position to rest upon the mounting surfaces of the T-bar members 15 and 16. The direction of movement of the first and second housings, as shown in FIGS. 9 and 10, is substantially perpendicular to a longitudinal axis 151 (FIG. 1) of a lamp 150, thereby allowing the lighting fixture to be moved between contracted and expanded positions with lamps 150 and 152 secured to the lighting fixture. Thus, the lighting fixture is easily installed in the ceiling grid 13, and the installer does not need to make a return trip to install lamps, reflectors or other accessories. By deflecting the tabs 81 and 83 inwardly, the lighting fixture may be moved back to a contracted position to remove the lighting fixture from the ceiling grid.

Figure 8:
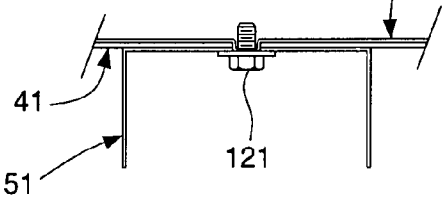
FIG. 8 is an exploded side elevational view of a boss of a fastener securing a channel to the housing assembly.

Movement of the first and second housings 31 and 41 is accommodated by the-elongated slots 111, 112, 113 and 114 of the second housing. The bosses 61, 62, 64 and 63 of the first housing extend downwardly slightly into the fastener holes 52 in the channel 51. The second housing 41 is sandwiched between the first housing 31 and the channel 51, as shown in FIG. 8, with a slight frictional fit. However, movement of the second housing along the slot is permitted by the frictional fit between the first and second housings and the channel.

Retaining members 65, 67, 69, 165, 167 and 169 on the first and second housings 31 and 41 are adapted to receive reflectors 131 and 133 upon moving the lighting fixture 11 to an expanded position.

Once the lighting fixture 11 is resting on the T-bar support members, mounting clips 71 may be installed to prevent accidental dislodging of the lighting fixture by upward forces thereon. As shown in FIGS. 12-14, the mounting clip is positioned above the lighting fixture by accessing through an adjacent opening 19 in the ceiling grid 13. The mounting clip is moved with a slight force downwardly, indicated by the arrow. The resiliency of the second leg 205 allows the second leg to deflect inwardly past the base 201 of the T-bar support member, as shown in FIG. 13. Once the second leg 205 has moved completely past the base of the T-bar support member, the resiliency of the second leg moves the second leg back to its unbiased position, thereby causing second end 206 of the second leg to be positioned proximal the lower portion 200 of the base of the T-bar support member. Upward forces cause the second end 206 of the second leg 205 of the mounting clip to push into the lower portion 200 of the base 201, thereby substantially preventing movement of the lighting fixture 11.

While a particular embodiment has been chosen to illustrate the invention, it will be understood by those skilled in the art that various changes and modifications may be made therein without departing from the scope of the invention as defined in the appended claims.

What is claimed is:

1. A mounting clip for a lighting fixture disposed in a ceiling grid, comprising:

a first leg disposed proximal the lighting fixture;

a resilient second leg extending outwardly from one end of said first leg and away from the lighting fixture, said second leg engaging a base of the ceiling grid to substantially prevent upward movement of the lighting fixture and deflected toward said first leg to disengage the base of the ceiling grid for removal of the lighting fixture; and a third leg extending outwardly from another end of said first leg and away from the lighting fixture, said third leg engaging the base of the ceiling grid, wherein said mounting clip is slidably disposed in a spaced provided between the lighting fixture and the ceiling grid after the lighting fixture is installed in the ceiling grid by directly engaging the lighting fixture with the ceiling grid.

2. A mounting clip according to claim 1, wherein said first leg has first and second ends, said second leg extending from said first end of said first leg and said third leg extending from said second end of said first leg.

3. A mounting clip according to claim 1, wherein said third leg extends substantially perpendicularly from said first leg.

4. A mounting clip according to claim 1, wherein said third leg is substantially L-shaped such that a first end of said third leg is connected to said first leg and a second end of said third leg is adapted to engage the ceiling grid.

5. A mounting clip according to claim 1, wherein said second leg extends toward said third leg.

6. A mounting clip according to claim 1, wherein said mounting clip is made of stainless steel.

7. A mounting clip for a lighting fixture disposed in a ceiling grid formed by a plurality of T-bar members, comprising:

a first leg disposed proximal the lighting fixture;

a resilient second leg extending outwardly from one end of said first leg and away from the lighting fixture, said second leg engaging a lower portion of the base of a T-bar member of the ceiling grid to substantially prevent upward movement of the lighting fixture and deflected toward said first leg to disengage the base of the T-bar member for removal of the lighting fixture;

a third leg extending outwardly from another end of said first leg and away from the lighting fixture; and a fourth leg extending from said third leg toward said second leg, said fourth leg engaging an upper portion of the base of the T-bar member to prevent downward movement of said mounting clip, wherein said mounting clip is slidably disposed in a spaced provided between the lighting fixture and the ceiling grid after the lighting fixture is installed in the ceiling grid by directly engaging the lighting fixture with the ceiling grid.

8. A mounting clip according to claim 7, wherein said mounting clip is made of stainless steel.

9. A mounting clip according to claim 7, wherein said first leg has first and second ends, said second leg extending from said first end of said first leg and said third leg extending from said second end of said first leg.

10. A mounting clip according to claim 9, wherein said third leg has first and second ends, said first end of said third leg being connected to said second end of said first leg and said fourth leg extending from said second end of said third leg.

11. A mounting clip according to claim 10, wherein said fourth leg extends substantially perpendicularly from said third leg.

12. A mounting clip according to claim 7, wherein said third leg extends substantially perpendicularly from said first leg.

13. A method of securing a lighting fixture in a ceiling grid formed by a plurality of T-bar members, comprising the steps of directly engaging the lighting fixture with the ceiling grid to install a lighting fixture in the ceiling grid formed by a plurality of T-bar members;

deflecting a second leg extending outwardly from one end of a first leg of a mounting clip by inserting the mounting clip in a space provided between a base of one of the T-bar members and the lighting fixture after the lighting fixture is installed in the ceiling grid;

engaging an end of the second leg with a lower portion of the base of the T-bar member to substantially prevent upward movement of the lighting fixture; and engaging a third leg extending outwardly from another end of the first leg with an upper portion of the base of the T-bar member to support the mounting.

14. A method of securing a lighting fixture in a ceiling grid formed by a plurality of T-bar members according to claim 13, further comprising disposing the first leg of the mounting clip proximal a wall of the lighting fixture.

15. A method of securing a lighting fixture in a ceiling grid formed by a plurality of T-bar members according to claim 14, further comprising deflecting the second leg of the mounting clip inwardly; and pulling upwardly on the mounting clip to remove the mounting clip from between the lighting fixture and the T-bar member.

16. A method of securing a lighting fixture in a ceiling grid formed by a plurality of T-bar members according to claim 15, further comprising removing the lighting fixture after the mounting clip has been withdrawn.

17. A method of securing a lighting fixture in a ceiling grid formed by a plurality of T-bar members according to claim 13, wherein engaging the third leg with the base of the T-bar member comprises hooking the third leg over the base of the T-bar member to substantially prevent further downward movement of the mounting clip.

* * * * *